US006705219B2

(12) United States Patent
Douillard et al.

(10) Patent No.: US 6,705,219 B2
(45) Date of Patent: Mar. 16, 2004

(54) ROTARY OFFSET PRINTING UNIT WITH RUBBER BLANKET BELT AND OFFSET PRINTING METHOD

(75) Inventors: Gerald Roger Douillard, Epping, NH (US); Eric Michael Lapine, Northwood, NH (US); Michael Robert Lemelin, Madbury, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/948,264

(22) Filed: Sep. 6, 2001

(65) Prior Publication Data

US 2003/0041757 A1 Mar. 6, 2003

(51) Int. Cl.[7] ..... B41F 13/02

(52) U.S. Cl. ..... 101/221; 101/216; 101/217; 101/218; 101/219; 101/220; 101/171; 101/177; 101/178; 101/179

(58) Field of Search ..... 101/212, 216, 101/217, 218, 219, 220, 221, 171, 177, 178, 179

(56) References Cited

U.S. PATENT DOCUMENTS 5,209,159 A * 5/1993 Asanuma ..... 101/112
5,794,829 A 8/1998 Perrault
5,816,151 A * 10/1998 Wang et al. ..... 101/171
5,907,997 A 6/1999 Jackson et al.
6,105,498 A 8/2000 Vrotacoe et al.
6,205,921 B1 * 3/2001 Dzierzynski et al. ..... 101/217

FOREIGN PATENT DOCUMENTS

DE 44 42 983 A1 6/1996
DE 4442983 A1 * 6/1996 ..... B41F/31/00
JP 7266533 10/1995

* cited by examiner

*Primary Examiner*—Ren Yan
*Assistant Examiner*—Andrea H. Evans
(74) *Attorney, Agent, or Firm*—Laurence A. Greenberg; Werner H. Stemer; Ralph E. Locher

(57) ABSTRACT

The web-fed rotary offset printing machine utilizes a blanket belt onto which two or more colors are offset and which prints the two or more colors at once onto a material web. The blanket belt travels about guide rollers which have a lesser mass and/or a lesser diameter than the form cylinders which offset the colors onto the blanket belt. If several impression nips—blanket to web nips—are formed along the travel path of the material web, they are located so close to one another that fan out register errors cannot occur.

8 Claims, 4 Drawing Sheets

ROTARY OFFSET PRINTING UNIT WITH RUBBER BLANKET BELT AND OFFSET PRINTING METHOD

BACKGROUND OF THE INVENTION

FIELD OF THE INVENTION

The invention lies in the printing technology field. More specifically, the invention relates to an offset printing unit and a corresponding offset printing method.

In rotary offset printing, the image to be printed is offset from a form cylinder onto a rubber blanket, and it is subsequently offset from the rubber blanket to the surface to be printed. Typically, the form cylinder is a plate cylinder, i.e., a roller which carries a printing plate onto which ink and water is applied in accordance with the image pattern on the plate. The rubber blanket typically forms the peripheral surface of a rubber blanket cylinder with the same diameter as the plate cylinder.

Japanese patent application JP 7-266533 discloses a printing press in which the rubber blanket is formed by a blanket belt which is guided about two blanket rollers. The two blanket rollers have the same diameter as the plate cylinder. One of the guide rollers defines the offset nip between the plate cylinder and the blanket, and the other guide roller defines the printing nip (the line along which the ink is transferred onto the paper) between the blanket and the paper web. The object pursued by the Japanese disclosure, is to move the respective printing nips of the various printing units closer towards one another so as to reduce the disadvantageous effect of fan-out registration errors. Since, in the Japanese disclosure, the diameters of the blanket cylinders are equal to the diameters of the plate cylinder, and each of the printing units (each unit prints one color) thus require six such full-diameter cylinders for double-sided web printing, the construction costs for that printing press and the attendant space requirements are enormous.

German published patent application DE 44 42 983 discloses a sheetfed printing machine with two plate cylinders which transfer a first and a second color to a common blanket belt. The blanket belt is guided about two blanket cylinders with the same diameter as the plate cylinders. The system is used to reduce the number of transfer cylinders for the paper sheets, but it does not have a bearing on the fan-out registration problem. The number of necessary cylinders (i.e., plate cylinders and blanket cylinders) is not reduced relative to the conventional prior art machines and the space needed for the printing units is the same as in conventional sheetfed printing units with conventional rubber blanket rollers.

U.S. Pat. No. 5,907,997 discloses a satellite printing unit with four print and blanket cylinder couples that are arranged around a central impression cylinder. The system requires a substantial amount of space and, importantly, it can only be implemented with short ink trains and dampener trains. Moreover, the number of equal-diameter plate and blanket cylinders is not reduced.

The term fan-out registration is a term used in the art to describe the effect of paper web expansion during the printing operation. As the paper web travels through the individual printing units, a considerable amount of ink and water are offset onto the web. The water thereby causes the web to expand. The primary expansion, due to the prevalent longitudinal alignment of the paper fibers in the web, is in the lateral direction, i.e., transverse to the web travel direction. This can lead to considerable misregistration among the various printing units, with the misregistration between the color of the first unit and the color of the last unit naturally being the most noticeable. The fan-out problem becomes especially pronounced in very wide printing machines, such as the four page wide machines with rollers having an axial length of more that 60 inches.

Fan-out misregistration has conventionally been compensated for by a (predicted) shifting of the downline printing plates into better registration. That is, plate register pins are moved so that the position of the plate relative to the centerline of the printing machine will coincide with the predicted position of the preceding color after the expected amount of growth. Additionally, it has been known to subject the web to so-called bustle wheels just upline of each of the following printing units. The bustle wheels cause a slight crumpling and shrinking of the web just prior to its entry into the following printing nip (see, for example, U.S. Pat. Nos. 5,794,829 and 6,105,498).

These counter-measures are only static solutions which compensate for predicted errors. They do not account for dynamic changes in the press such as varying web properties or varying print coverages.

SUMMARY OF THE INVENTION

It is accordingly an object of the invention to provide a rotary offset printing machine with a rubber blanket belt, which overcomes the above-mentioned disadvantages of the heretofore-known devices and methods of this general type and which reduces or eliminates fan-out registration errors and is enabled to reduce or eliminate color registration errors during make-ready without causing paper waste.

With the foregoing and other objects in view there is provided, in accordance with the invention, an offset printing unit for printing a material web, comprising:

- a first form cylinder for transferring a first color, the first form cylinder having a form cylinder diameter;
- a second form cylinder for transferring a second color, the second form cylinder having the form cylinder diameter;
- a plurality of guide rollers respectively disposed in vicinity of the first and second form cylinders and of a material web to be imprinted, the guide rollers having a diameter smaller that the form cylinder diameter and/or a mass that is less than that of the form cylinders; and
- an endless blanket belt disposed to revolve around the guide rollers and to form with the first and second form cylinders respective offset nips at which the blanket belt receives the first color from the first form cylinder and the second color from the second form cylinder, and to form an impression nip with the material web at which the material web receives the first and second colors from the blanket belt.

In accordance with an added feature of the invention, the first and second form cylinders are plate cylinders.

In accordance with an additional feature of the invention, a third and a fourth form cylinder are disposed mirror-symmetrically to the first and second form cylinders across the material web, a further plurality of guide rollers disposed opposite the guide rollers across the material web, and a further endless blanket belt disposed to revolve about the further guide rollers, to form respective offset nips with the third and fourth form cylinders, and to offset colors received from the third and fourth form cylinders onto the material web across from the first above-mentioned impression nip.

In accordance with an alternative embodiment of the invention, a third and a fourth form cylinder disposed to form respective offset nips with the blanket belt for offsetting onto the blanket belt a third and a fourth color respectively, and whereby the blanket belt simultaneously imprints onto the material web up to four colors at the impression nip.

In accordance with another feature of the invention, the form cylinders have a diameter substantially twice the diameter of the guide rollers.

In accordance with a further feature of the invention, two H-type units are stacked one above the other, each comprising at least two form cylinders, and wherein the guide rollers are disposed to form respective impression nips of the two H-type units at a spacing distance less than twice the form cylinder diameter.

In accordance with a preferred embodiment of the invention, a camera is disposed at a location downline from the second form cylinder in a blanket belt travel direction and configured to record a coverage of the first and second color on the blanket belt, and a computer connected to the camera and to the form cylinders for setting a register of the first and second colors on the blanket belt in response to a signal received from the camera.

With the above and other objects in view there is also provided, in accordance with the invention, an offset printing method, which comprises:

providing an endless rubber blanket belt disposed to revolve about a plurality of guide rollers;

offsetting a plurality of colors onto the blanket belt at respective offset nips formed between the blanket belt and a plurality of form cylinders disposed along a travel path of the blanket belt;

ascertaining a register between the plurality of colors and continuing the offsetting step until register has been attained; and after register between the plurality of colors has been attained, throwing on the blanket belt onto a material web and simultaneously printing the plurality of colors at a single impression nip formed between the blanket belt and the material web.

In accordance with again an added feature of the invention, four colors are offset onto each of two blanket belts disposed on opposite sides of the material web, and both sides of the web are simultaneously printed each with up to four colors.

In accordance with a concomitant feature of the invention, four blanket belts are provided and each is configured to have offset thereon at least two colors. In this case, the material web is imprinted with at least two of the four blanket belts at respective impression nips disposed in close vicinity along the material web.

The primary advantageous feature of the invention is thus the use of a single blanket from which at least two colors can be transferred from two form cylinders onto the print material. The problem of fan-out registration is therefore eliminated between the two colors. The blanket belt, furthermore, is guided about small-diameter guide rollers, which leads to a substantial savings in material cost and space requirement. The novel system no longer requires equal diameter plate and blanket cylinders and the system is not limited to short inkers.

It has been found to be a further, yet substantial, advantage of the invention, that it is possible with the new system to completely adjust the register of different colors on the blanket belt before the belt is brought into contact with the paper web. Accordingly, the color register can be completely during make-ready, without wasting any paper.

Due to the light-weight and smaller diameter construction of the guide rollers (two of which also form the impression rollers), it is possible to very quickly react to a web break. In that case, the low-mass rollers can be quickly retracted out of contact with the paper web.

It is yet a further advantage of the invention that the number of motors can be reduced. For example, in a five high printing tower (CMYB, plus an extra color) with three motor drives, it is possible to save four motors and the plate cylinders can be evenly spaced along the printing units.

Several auxiliary units can be dispensed with in accordance with the invention. For example, only a single blanket washer is required for each belt. If the belt is used as a four-color offset blanket, for example, three blanket washers can be eliminated as compared with the prior art system.

Finally, by utilizing segmented blanket belts which can be selectively lengthened and shortened, it is possible to change over among a variety of systems, as will become clear from the following description of the preferred embodiments.

Other features which are considered as characteristic for the invention are set forth in the appended claims.

Although the invention is illustrated and described herein as embodied in a printing machine with a rubber blanket belt, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
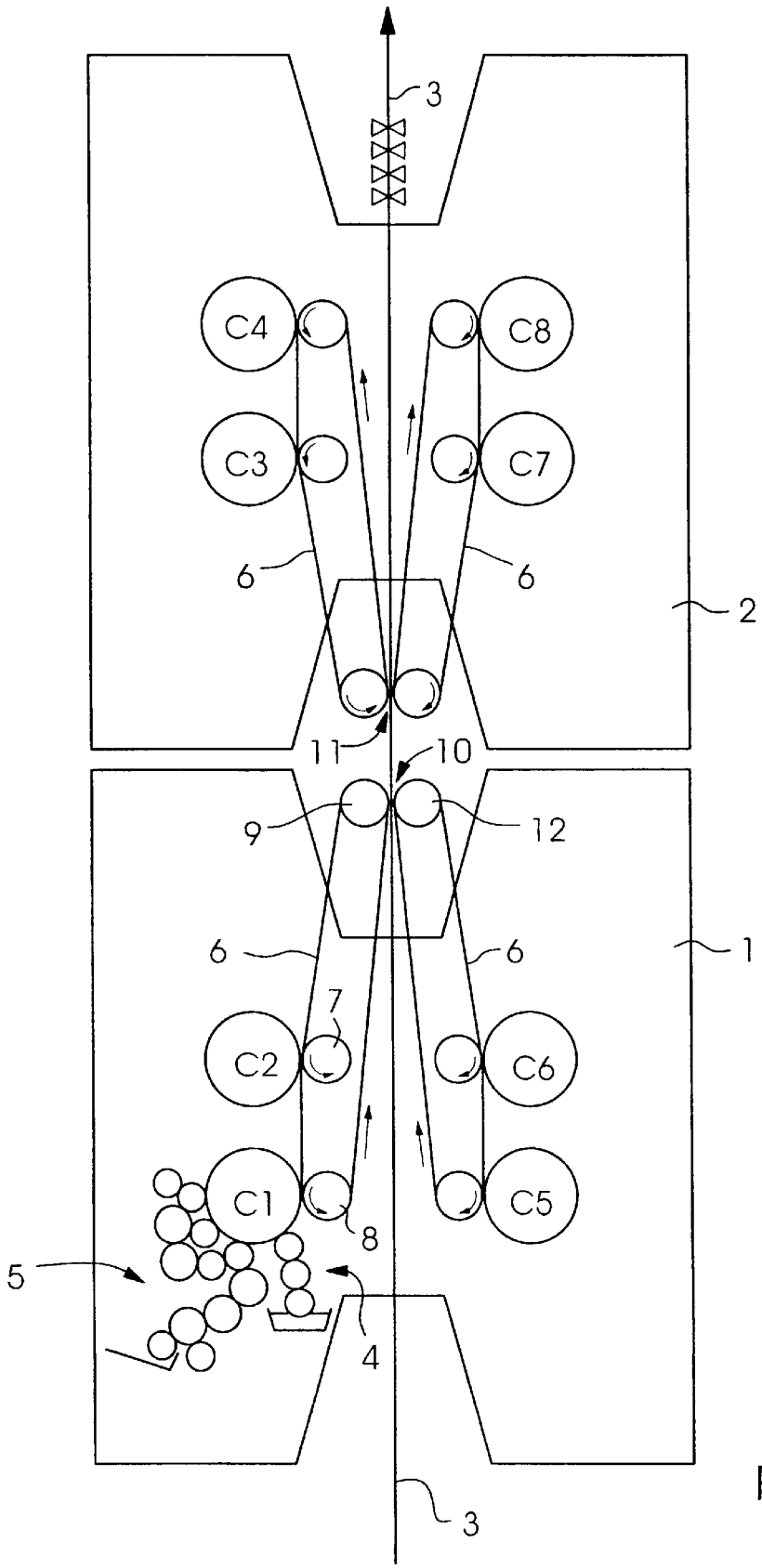
FIG. 1 is a diagrammatic side view of a stack of two H-type printing units.

Referring now to the figures of the drawing in detail and first, particularly, to FIG. 1 thereof, there is seen a first H-type printing unit 1 and a second H-type printing unit 2 stacked on the first printing unit 1. The H-type units are to be understood as exemplary only. The inventive concept applies to a variety of configurations, such as to arch-type printing units, and the like. A web 3 travels centrally in the printing units, entering unprinted (0/0) at the bottom and exiting with up to four colors on each side (4/4) at the top.

Each of the printing units 1, 2 in FIG. 1 includes four plate cylinders. The plate cylinders that carry the image of one side of the web 3 (the left side) in four colors are successively identified as C1, C2, C3, and C4. The image on the other side of the web 3 (the right side) is defined by the cylinders C5, C6, C7, and C8. Each of the plate cylinders is assigned a dampener train 4 and an ink train 5. Only one such system is illustrated for clarity. An endless rubber blanket belt 6 revolves about guide rollers 7, 8, and 9. Print couples are formed between each of the plate cylinders and the belt 6. The two colors which are offset onto the blanket belt 6 at the print couples 7/C2 and 8/C1 are transferred to the web 3 at a blanket belt to web nip 10.

As seen in FIG. 1, the horizontally mirrored configuration of the belt 6 of the printing unit 2 assures that a blanket belt to web nip 11 is located in close vicinity to the nip 10. Furthermore, the smaller diameter of the guide rollers 9 and 12, as well as 9' and 12', allows the impression nips to be located very close to one another with reference to the imprint location on the web 3. This is important with regard to fan-out registration. By imprinting at the nip 11 immediately after imprinting at the nip 10, the web 3 is not able expand to any appreciable degree, and fan-out registration errors are thus avoided. It is seen as critical, with regard to fan out registration, that the diameters of the guide rollers 9 and 12 (9' and 12') be chosen to be smaller than the diameters of the form cylinders C1 . . . C8.

The embodiment illustrated in FIG. 1 utilizes the guide roller 12 as the counter-pressure roller for the imprint on the front side of the web 3. The roller 9, conversely, is utilized as the counter-pressure roller for the imprint on the back side of the web 3.

Figure 2:
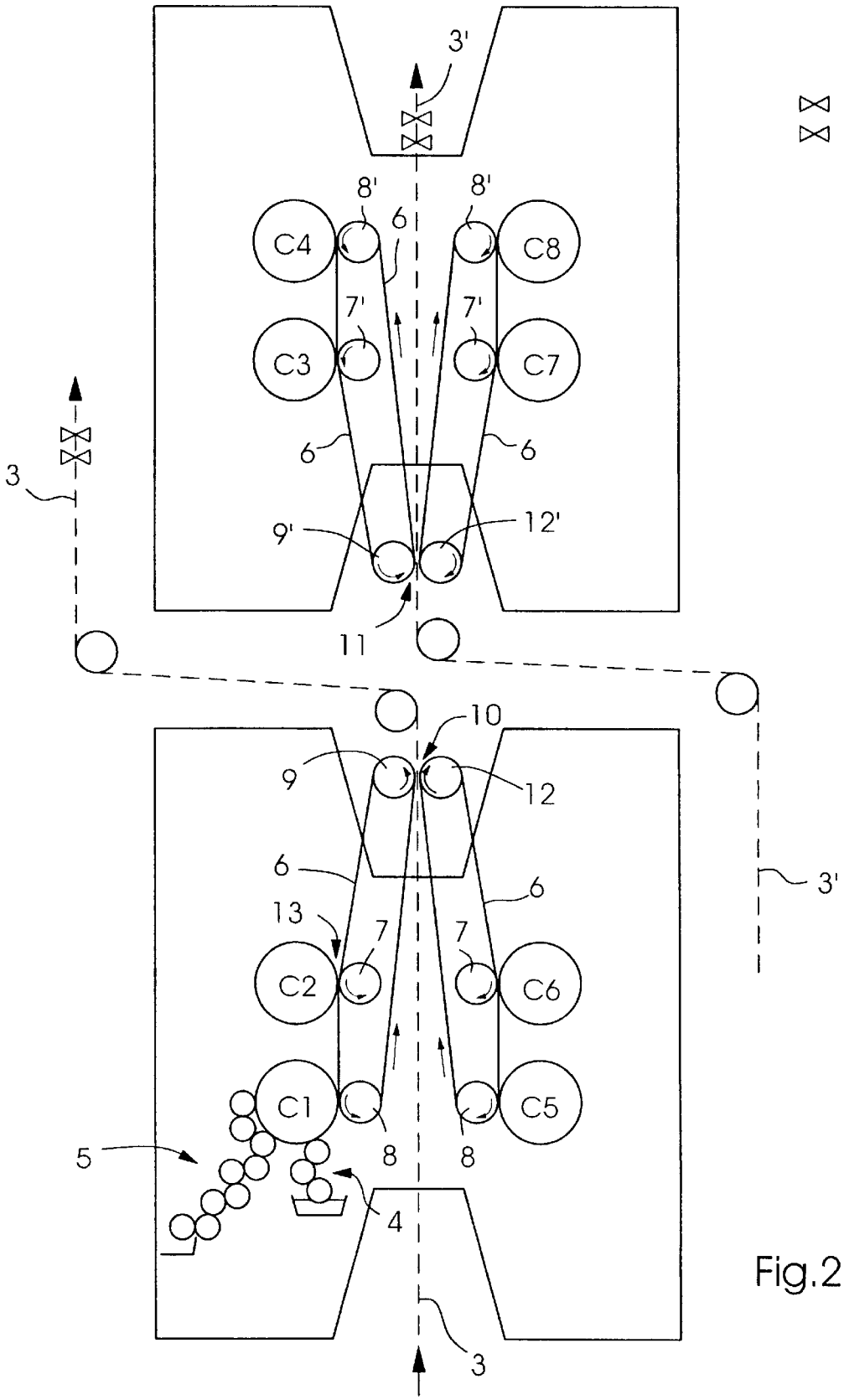
FIG. 2 is a side view of the two printing after conversion to separate and independent printing.

Referring now to FIG. 2, the two printing units 1 and 2 can also be operated independently of one another. In this case, the web 3 that enters the printing unit 1 from below exits from between the two units 1 and 2 after having been imprinted with a maximum of two colors 2/2 on each side. A web 3' is fed into the space between the printing units 1 and 2 and runs through the upper printing unit 2. From there the web 3' exits with a maximum of two colors 2/2 on each side.

Figure 3:
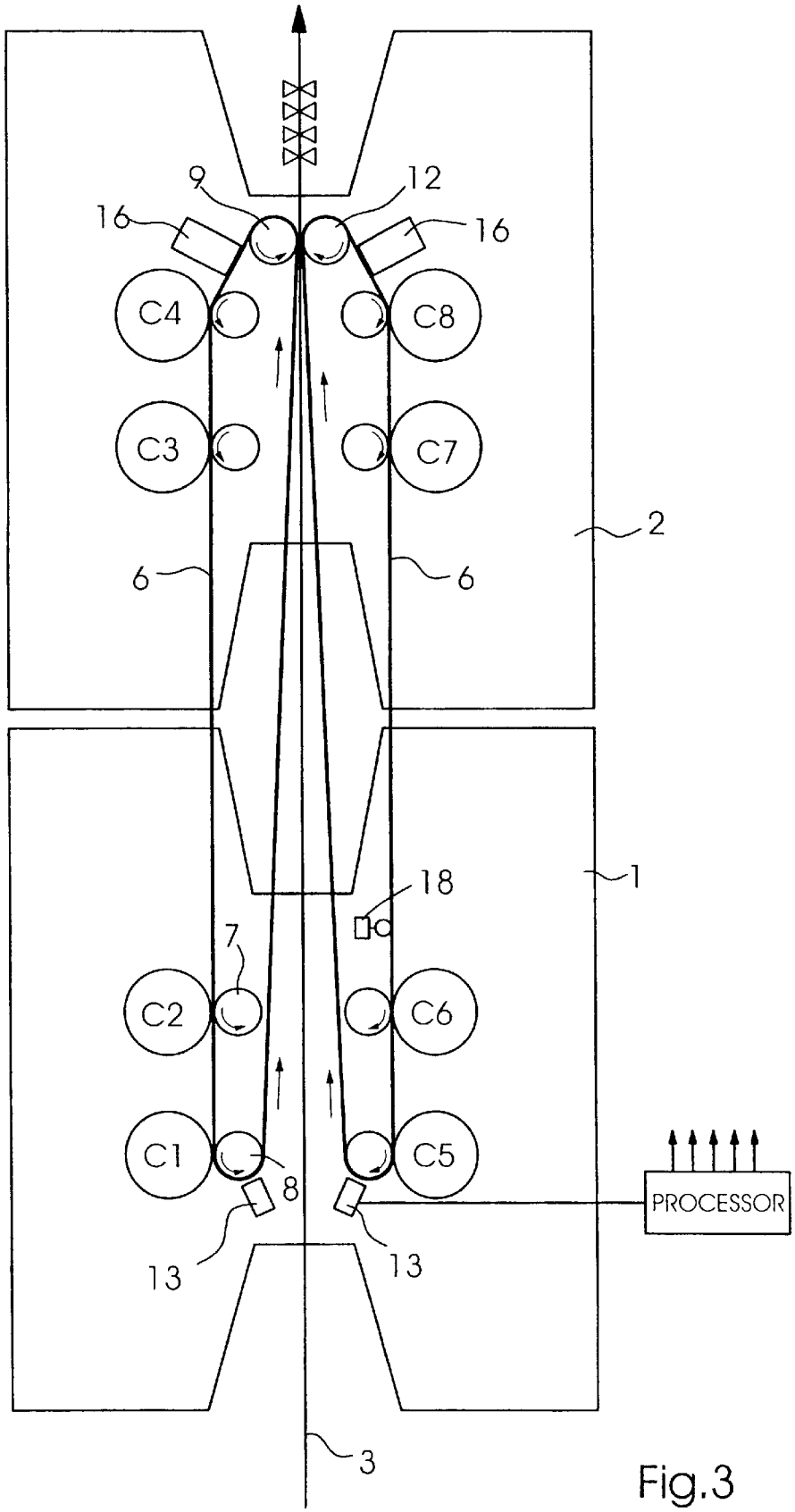
FIG. 3 is a diagrammatic side view of a stack of two printing units with a common blanket belt for multicolor offset.

Referring now to FIG. 3, there is illustrated a further variation of the inventive concept. Here, four colors are offset onto the blanket belt 6 and the four colors are simultaneously imprinted onto the web 3 in a single blanket to web nip. Due to the simultaneity of the multi-color imprint, the registration problems associated with the fan-out phenomenon are completely eliminated in this embodiment. It is also advantageous that only a single blanket washer 17 is necessary per blanket belt. A further advantage becomes apparent: It is possible with this embodiment of the invention to completely set the color register during make-ready without wasting any paper. For this purpose, a camera 13 is positioned downstream of the last print couple 8/C1 in the travel direction of the web, i.e., between the last print couple and the blanket belt to web nip. The camera 13 is connected to a color control processor or the printing unit controller. The camera provides the necessary information with regard to location of the four colors that have been offset from the cylinders C4, C3, C2, and C1 as the blanket belt 6 travels by in the counter-clockwise direction. The information signal from the camera 13 is processed and corresponding signals are sent to the various setting actuators from the printing unit processor, so that the register and the proper color controls may be set. During the make-ready registration process, the guide rollers 9 and 12 are thrown off (dashed positions 9' and 12') so that the blanket belt 6 does not touch the web 3. The web 3, therefore, stands still during the make-ready operation and no paper is wasted.

Figure 4:
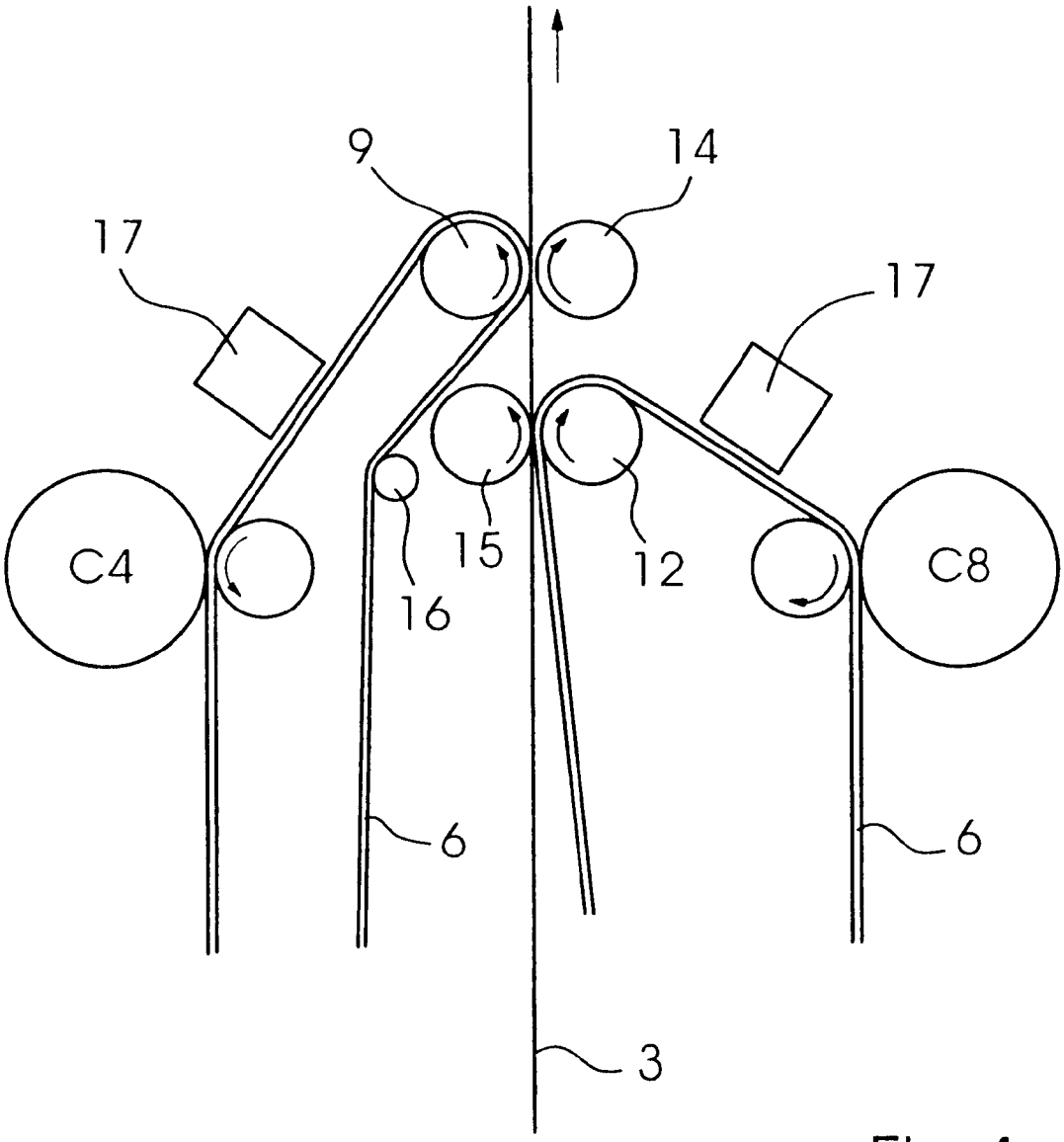
FIG. 4 is a partial diagrammatic side view of the impression nips with separate counter pressure rollers.

FIG. 4 illustrates an embodiment of the invention which allows selective one-sided printing on the web 3 without taxing the opposite-side blanket belt as a counter-pressure element. The guide roller 9 (which defines the front-side blanket to web nip) here is countered by a counter-pressure roller 14 and the guide roller 12 (which defines the backside blanket to web nip) is countered by a counter-pressure roller 15. The rollers 14 and 15 are preferably soft rubber rollers, or the like. The blanket belt 6, furthermore, is suitable deflected by a guide roller 16. In this embodiment, therefore, it is possible to imprint the web 3 only on one side, and throw off the guide roller for the opposite blanket belt for make-ready of a further print job.

The blanket washer 17 is placed so that the belt is washed after it leaves the impression nip and before it reaches the first plate cylinder C4, C8. Any number of tension control elements 18 are strategically distributed along the run of the blanket belt 6. Only one web tensioner 18 is illustrated in FIG. 3.

As noted above, the fact that the diameter of the blanket belt guide rollers 9 and 12 is smaller than the diameter of the form cylinders C1 . . . C8 is critical with regard to fan out registration. Similarly, it is critical with regard to quick throw-off and offset stoppage upon a web break or other print interruption that the guide rollers 7, 8, 9, 12, 7', 8', 9', 12' (and 14, 15) about which the blanket web travels have a smaller mass than the form rollers. In this case, it is not necessary that the guide rollers have a smaller diameter, but merely that they have less mass. Specifically in the embodiment illustrated in FIG. 3—with a single impression nip for all colors—the smaller diameter of the guide rollers is not as critical as their smaller mass.

We claim:

1. An offset printing unit for printing a material web, comprising:

a first form cylinder for transferring a first color, said first form cylinder having a form cylinder diameter;

a second form cylinder for transferring a second color, said second form cylinder having the form cylinder diameter;

a plurality of guide rollers respectively disposed in a vicinity of said first and second form cylinders and of a material web to be imprinted, said guide rollers having a diameter smaller than the form cylinder diameter;

an endless blanket belt disposed to revolve around said guide rollers and to form with said first and second form cylinders respective offset nips at which said blanket belt receives the first color from said first form cylinder and the second color from said second form cylinder, and to form an impression nip with the material web at which the material web receives the first and second colors from said endless blanket belts;

a camera disposed at a location downline from said second form cylinder in a blanket belt travel direction, said camera recording a coverage of the first and second color on said endless blanket belt; and a computer connected to said camera and to said first and second form cylinders for setting a register of the first and second colors on said endless blanket belt in response to a signal received from said camera.

2. The printing unit according to claim 1, wherein said first and second form cylinders are plate cylinders.

3. The printing unit according to claim 1, which further comprises a third and a fourth form cylinder disposed mirror-symmetrically to said first and second form cylinders across the material web, a further plurality of guide rollers disposed opposite said guide rollers across the material web, and a further endless blanket belt disposed to revolve about said further guide rollers, to form respective offset nips with said third and fourth form cylinders, and to offset colors received from said third and fourth form cylinders onto the material web across from said impression nip.

4. The printing unit according to claim 1, which further comprises a third and a fourth form cylinder disposed to form respective offset nips with said blanket belt for offsetting onto said blanket belt a third and a fourth color respectively, and whereby said blanket belt simultaneously imprints onto the material web up to four colors at said impression nip.

5. The printing unit according to claim 1, wherein said form cylinders have a diameter substantially twice the diameter of said guide rollers.

6. The printing unit according to claim 1, wherein two H-type units are stacked one above the other, each comprising at least two form cylinders, and wherein said guide rollers are disposed to form respective impression nips of said two N-type units at a spacing distance less than twice said form cylinder diameter.

7. An offset printing unit for printing a material web, comprising:

a first form cylinder for transferring a first color, said first form cylinder having a given form cylinder mass;

a second form cylinder for transferring a second color, said second form cylinder having the form cylinder mass;

a plurality of guide rollers respectively disposed in vicinity of said first and second form cylinders and of a material web to be imprinted, said guide rollers having a guide roller mass less than said form cylinder mass;

an endless blanket belt disposed to revolve around said guide rollers and to form with said first and second form cylinders respective offset nips at which said blanket belt receives the first color from said first form cylinder and the second color from said second form cylinder, and to form an impression nip with the material web at which the material web receives the first and second colors from said endless blanket belt; and a camera disposed at a location downline from said second form cylinder in a blanket belt travel direction, said camera recording a coverage of the first and second color on said endless blanket belt; and a computer connected to said camera and to said first and second form cylinders for setting a register of the first and second colors on said endless blanket belt in response to a signal received from said camera.

8. The printing unit according to claim 7, wherein said first and second form cylinders are plate cylinders.

* * * * *